United States Patent [19]

Stokley et al.

[11] 4,194,561

[45] Mar. 25, 1980

[54] PLACEMENT APPARATUS AND METHOD FOR LOW DENSITY BALL SEALERS

[75] Inventors: Charles O. Stokley; Steven R. Erbstoesser, both of Houston, Tex.

[73] Assignee: Exxon Production Research Company, Houston, Tex.

[21] Appl. No.: 852,174

[22] Filed: Nov. 16, 1977

[51] Int. Cl.[2] ..... E21B 33/124

[52] U.S. Cl. ..... 166/162; 166/284; 166/192; 166/214; 166/241

[58] Field of Search ..... 166/69, 72, 99, 107, 166/134, 136, 162, 165, 169, 210, 214, 215, 228, 230, 279, 284, 285, 117, 57, 59, 60, 192; 175/54, 58, 60, 72, 243, 246–249, 254, 290, 236, 309, 312, 380; 137/268; 294/68, 86.11

[56] References Cited

U.S. PATENT DOCUMENTS

| | | | |
|---|---|---|---|
| 1,241,003 | 9/1917 | Newsom | 166/214 X |
| 2,710,065 | 6/1955 | Hamilton, Jr. | 166/117 |
| 2,754,910 | 7/1956 | Derrick et al. | 166/284 |
| 2,933,136 | 4/1960 | Ayers et al. | 166/284 |
| 2,969,839 | 1/1961 | Greene | 166/162 X |
| 3,011,548 | 12/1961 | Holt | 166/284 |
| 3,086,587 | 4/1963 | Zandmer et al. | 166/284 |
| 3,174,546 | 3/1965 | Flickinger | 166/284 |
| 3,187,813 | 6/1965 | Greene, Jr. | 166/162 X |
| 3,292,700 | 12/1966 | Berry | 166/284 |
| 3,376,934 | 4/1968 | Willman et al. | 166/193 |
| 3,437,147 | 4/1969 | Davies | 166/305 |
| 3,460,625 | 8/1969 | Hart et al. | 166/285 |
| 3,463,229 | 8/1969 | Hinkle | 166/162 X |
| 3,547,197 | 12/1970 | Chevalier et al. | 166/284 |
| 3,595,314 | 7/1971 | Garner | 166/192 |
| 3,715,055 | 3/1973 | Kendrick et al. | 221/75 |
| 3,895,678 | 7/1975 | Wright et al. | 166/284 |
| 4,074,756 | 2/1978 | Cooke, Jr. | 166/285 X |

OTHER PUBLICATIONS

Brown, et al., "Stimulation Treatment Selectivity Through Perforation Ball Sealer Technology", *The Petroleum Engineer*, Jun. 1959.

Permeator Corp. (Canada) Ltd., "Permeator Well Completion Operator's Manual", Revised Sep. 1967, Copyright 1964.

Neill, et al., "An Inexpensive Method of Multiple Fracturing", *Drilling and Production Practice*, API, 1958, pp. 27–32.

Howard, "Ball Sealers in Fracturing and Acidizing", *Canadian Oil and Gas Industries*, Jan. 1962, pp. 43–46.

*Primary Examiner*—Ernest R. Purser
*Assistant Examiner*—Nick A. Nichols, Jr.
*Attorney, Agent, or Firm*—Gary D. Lawson; Robert B. Martin

[57] ABSTRACT

An apparatus and method for the selective placement of ball sealers for fluid treatment of a well, said ball sealers having a density less than the density of said fluid comprising a tubular member, means on said tubular member for positioning said apparatus in said well casing and means on said tubular member for deploying and blocking said well casing to prevent upward movement of said ball sealers past said apparatus.

23 Claims, 12 Drawing Figures

PLACEMENT APPARATUS AND METHOD FOR LOW DENSITY BALL SEALERS

BACKGROUND OF THE INVENTION

The present invention relates to the treating of wells and more particularly to the selective treatment of formation strata by temporary closing of perforations in the well casing during the treatment by means of ball sealers.

In the drilling of oil and gas wells numerous formations are penetrated, some containing oil and/or gas, water or being substantially devoid of fluids. In order to isolate the various formations penetrated by the well, the usual practice in completing oil and gas wells is to set a string of pipe, known as casing, in the well and placing cement around the outside of the casing. To establish fluid communication between the hydrocarbon bearing formation and the interior of the casing, the casing and its cement sheath are perforated.

At various times during the life of the well, it may be desirable or necessary to increase or restore the production rate of hydrocarbon by an appropriate stimulation treatment such as acid treatment or hydraulic fracturing. If only a short, single production zone in the well has been perforated, the treating fluid will flow in the zone where it is required. However, as the length of the perforated production zone or the number of perforated production zones increases the direction of the treatment fluid to the production zones where it is required becomes more difficult. The treatment fluid will tend to follow the course of least resistance and will most likely be consumed in those zones of highest permeability where it is least required, while the less permeable zones which require treatment would be left virtually untreated.

To overcome this problem and secure treatment of less permeable zones, the art has developed over the years several means of diverting the treating fluid from the most permeable to the less permeable zones.

The earliest means of diverting acid treating fluids were the use of oil insoluble soaps and gel materials to block the permeable zones. Thereafter downhole mechanical means, known as packers were devised for diversion. Although packers are effective, they are quite expensive due to the involvement of associated work-over equipment required during the tubing-packer manipulations. In addition, there is substantial increase in costs as the depth of the well increases.

As a result, considerable effort has been devoted to the development of alternative diverting methods, such as crushed naphthalenes, crushed oyster shells and limestone as blocking agents, commonly referred to as particulate diverting agents, and ball sealers. One of the most popular and widely used diverting techniques over the past 20 years has been the use of small rubber-coated balls, known as ball sealers to seal off the perforations inside the casing.

These ball sealers are pumped into the wellbore along with the formation treating fluid and are carried down the wellbore and onto the perforations by the flow of fluid through the perforations into the formation. The balls seat onto the perforations and are held there by the pressure differential across the perforation.

The major advantages which contributed to the popularity of the ball sealers are their ease of use, the positive shut off which was obtained independently of the formation and the resultant absence of formation damage.

The ball sealers of the prior art were simply injected into the well at the surface and transported by the treating fluid. Other than a surface ball injector no special or additional treating equipment was required. The ball sealers are designed to have an outer covering sufficiently compliant to seal a jet formed perforation and to have a solid rigid core which resists extrusion into or through the perforation. Therefore, the ball sealers will not penetrate the formation and permanently damage the flow characteristics of the well.

Until recently, ball sealers had four principal characteristics: (1) they are chemically inert in the environment of use, (2) they seal without extruding into the formation, (3) they must release from the perforation when the pressure differential across the perforation is relieved and (4) they are more dense than the treating fluid and sink to the bottom of the well when not seated in a perforation.

Although, the prior art ball sealers were quite successful, the seating efficiency of the high density ball sealers in the perforations was quite low and erratic. To overcome this problem generally an excess of balls beyond the available perforations were pumped into the well.

However, it has recently been discovered that ball sealers having a density less than the treating fluid have 100% seating efficiency. Although, the ball sealers having less density than the treating fluid may be fed from the surface, it is frequently desirable that the placement of these balls occur downhole through tubing located in the well casing.

SUMMARY OF THE INVENTION

The present invention relates to a method and an apparatus for selective placement of ball sealers, having a density less than a treating fluid, in a well casing for the diversion of the treating fluid. The present apparatus provides for selective zonal stimulation by emitting the ball sealers adjacent to and above the zone desired to be sealed and preventing the ball sealers from rising above apparatus to upper zones where sealing is not required. It is also advantageous to employ the present apparatus where relatively low flow rates are employed, such as matrix stimulation treatments, where the fluid is being forced into the formation at a rate such that the pores of the formation accept the flow without formation fracturing. By employing the present apparatus, the ball sealers are placed in close proximity to the zone of perforation to be sealed without having to be borne through a major portion of the well by the low flow rates, thereby achieving 100% sealing more quickly.

Basically, the apparatus comprises an elongated tubular member which contains the ball sealers therein for passage through the well to a point above and adjacent to the zone where sealing is desired. There are means provided for positioning the apparatus in the well casing (and in some embodiments means are provided to seat the apparatus and prevent further downward movement thereof) and means to prevent the buoyant ball sealers from rising past the apparatus. The ball sealers may be dispersed from the sealed apparatus by mechanical means or the fluid flow.

The deployed means to prevent the upward passage of the ball sealers is preferably located at or near the lower end of the tubular member, nearest the perforations to be sealed. It may be a diaphragm of a continuous material or a diaphragmatic arrangement of elements and may be solid or in some embodiments an open mesh or grid with the openings therein being smaller than the ball sealers.

The present apparatus may be placed in position through the casing bore if there is no tubing or through production tubing located in the casing.

Quite generally, production tubing is located in the casing to provide a system for the protection of the casing, to provide means to isolate zones, to provide a situs for subsurface equipment, such as safety valves and for the employment of artificial lifting techniques.

The present apparatus is particularly adapted to operate through such tubing, yet seat in a substantially fixed position in the casing to carry out its function. The apparatus, however, is recoverable and the fixed nature of its location in the casing is relative to the upward force exerted to recover it. That is to say, it may be recovered by means of a fixed cable attached thereto or if not attached to a surface cable, it may be recovered by the appropriate fishing tool. It may be recovered, directly from the casing or through the production tubing.

In one embodiment of the present invention the apparatus has means for positioning in a desired position and has means to deploy and block the upward passage of ball sealers past the apparatus, however both of said means allow further downward movement of the apparatus. In this embodiment the apparatus is used first to selectively place the ball sealers during a fluid treatment and after termination of the treatment the apparatus is forced downward in the casing, for example to the rathole, taking the freed buoyant balls with it. The balls and the apparatus may be abandoned, thereby avoiding the problem of the buoyant balls in the wall. This embodiment would be particularly advantageous where the fluid treatment is in an injection well, since the ball sealers, unless removed, would tend to plug the perforations when the injection fluid was introduced in the well.

Another aspect of the present invention is the method of selectively sealing perforations or zones of perforations, which comprises passing the apparatus of the present invention through production tubing into the well casing, the tubular member releasably containing a plurality of independent sealing members, such as buoyant ball sealers therein, positioning the apparatus adjacent to and above the perforations to be sealed, deploying the means to the casing around the apparatus, releasing the independent sealing members into the well casing below the apparatus, and creating a pressure differential across the perforations, for example by a flow of a fluid into the well casing, to cause the independent sealing members to seat onto the perforations thereby sealing them.

Thus, for example, where it is desirable to fluid treat an upper zone of perforations and not to treat a lower zone of perforations, the process as described above is carried out by positioning the apparatus or at least the deploying and blocking means between the two zones and to selectively seal the lower zone, leaving the upper zone free of independent sealing members and the upper perforations open for treatment.

DESCRIPTION OF PREFERRED EMBODIMENTS

Figure 1:
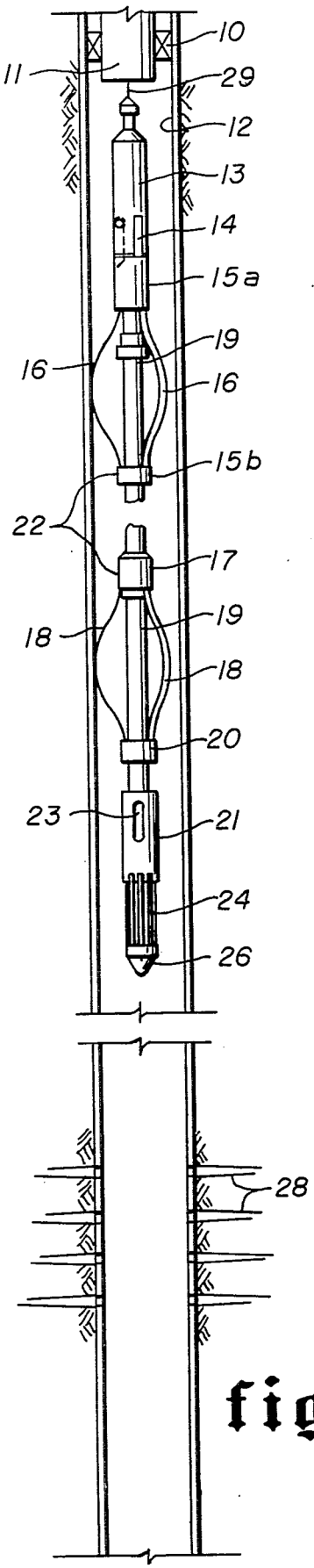
FIG. 1 is a schematic view of one embodiment of the present invention being lowered into a well casing through production tubing.

The prior art taught that it is preferred for the density of the ball sealers to be greater than the density of the treating fluid. It is worth examining the prior art ball sealer seating mechanism to be able to contrast it to the ball sealers having density lower than the treating fluid. The velocity of ball sealers more dense than the fluid in the wellbore is comprised of two components. Each ball sealer has a settling velocity which is due to the difference in the densities of the ball sealer and the fluid and is always a vertically downward velocity. The second component of the ball sealer's velocity is attributable to the drag forces imposed upon the ball sealer by the moving fluid shearing around the ball sealer. This velocity component will be in the direction of the fluid flow. Within the production tubing or within the casing above the perforations, the velocity component due to the fluid will be generally downward.

Just above the perforated part of the casing the fluid takes on a horizontal velocity component directed radially outward toward and through the perforations. The flow through any perforation must be sufficient to draw the ball sealer to the perforation before the ball sealer sinks past that perforation. If the flow of the treating fluid through the various perforations does not draw the ball sealer to a perforation by the time the ball sealer sinks past the lowest perforation, the ball sealer will simply sink into the bottom of the wellbore (rathole) where it will remain.

In contrast, when ball sealers have a density less than the density of the treating fluid, each ball sealer has a velocity comprised of two opposing components. The first velocity component is directed vertically upward due to the buoyancy of the ball sealer in the fluid. The second velocity component is attributable to the drag forces imposed upon the ball sealer by the motion of the fluid shearing past the ball sealer. Above the perforations, this second velocity component will be directed generally downward. It is essential that the downward fluid velocity in the production tubing and in the casing above the perforations be sufficient to impart a downward drag force on the ball sealers which is greater in magnitude than the upward force of buoyancy acting on the ball sealers. This results in the ball sealers being carried downward to the section of the casing which has been perforated.

When ball sealers having density less than the treating fluid are utilized, they will never remain in the rathole; that is, below the lowest perforation through which the treating fluid is flowing, due to the buoyancy of the ball sealers. Below the lowest perforation accepting the treating fluid, and fluid in the wellbore remains stagnant. So, there are no downwardly directed drag forces acting on the ball sealers to keep them below the lowest perforation taking the treating fluid. Hence, the upward buoyancy forces acting on the ball sealers will dominate in this interval.

Therefore, the use of the ball sealers less dense than the fluid results in the vertical velocity of each ball sealer being a function of its vertical position within the casing. At least below the lowest perforation, and possibly higher if little fluid is flowing down to and through the lower perforations, the net vertical velocity of each ball sealer will be upward due to the dominance of the buoyancy force over any downward fluid drag force. At least above the highest perforation, and possibly lower if little fluid is flowing through those higher perforations, the net vertical velocity of each ball sealer will be downward due to the dominance of the downward fluid drag force over the buoyancy force.

A ball sealer having a density less than the density of the treating fluid will remain within, or moving toward, that portion of the casing between the uppermost perforation and the lowermost perforation through which fluid is flowing until the ball sealer seats upon a perforation. While suspended within that portion of the casing, the motion of the fluid radially outward into and through the perforations will exert drag forces on the ball sealers to move them radially outward to the perforations where they will seat and be held there by the pressure differential.

The net result is that the ball sealers less dense than the fluid injected into the well and transported to the perforated zone of the casing will always seat upon and plug the perforations through which fluid is flowing with an invariable 100% efficiency. That is, each and every ball sealer will seat and plug a perforation as long as there is a perforation through which fluid is flowing and the flow of fluid down the casing above the uppermost perforation is sufficient to impart a downward drag force on each ball sealer greater in magnitude than the buoyancy force acting on that ball sealer.

When the treatment has been completed and the pressure differential relieved or reversed, the ball sealers will unseat from the perforations. With ball sealers having a density less than the treating fluid, in accordance with the present invention, all ball sealers will naturally migrate upward and may be recovered.

It is understood that perforation sealing devices having a configuration other than spherical are also included within the term "ball sealers".

Figure 2:
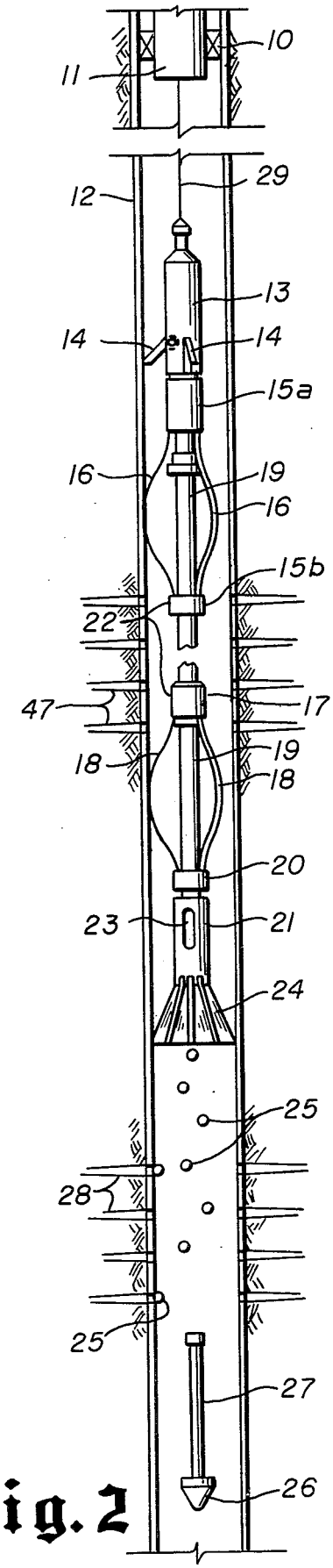
FIG. 2 is the schematic view of the embodiment of FIG. 1 being positioned and operated in the well casing.

Turning now to the drawings, FIGS. 1 and 2 show one embodiment of the present apparatus in a schematic view in location in a well casing. FIG. 1 shows the placement apparatus 22 having passed through production tube 11 which is held in the well casing 12 by packer 10. The bowed springs 16 and 18 are attached to slidable collars 15*a* and *b* and 20 respectively, thereby allowing the springs to conform to the bore of the production tube and to expand on leaving the tube to conform to the bore of the well casing 12.

When the placement apparatus is located adjacent to and above the perforations 28 and the formation which are to be subjected to sealing, as shown in FIG. 2, the apparatus of this embodiment is more firmly seated by drawing the cable 29 upward toward the surface which causes the bowed springs 16 to bind on the casing causing the sleeves 15*a* and 15*b* to slide down the tubular member 19 thereby releasing the seating members 14 which are biased within the mandrel 13 and to contact the casing wall and prevent further downward movement of the apparatus in the casing. At the same time (by apparatus shown in more detail in FIGS. 3, 4, 5 and 6 to be discussed shortly hereafter), the pushoff rod 27 which is connected to the end cap 26 is released and allowed to fall away to the well bottom, allowing the expandable diaphragm 24 to expand, thereby blocking the casing at that point. This allows the ball sealers 25 to be moved out of the tubular member 19 (by means not shown in this drawing). The treatment fluid flows through the ports 23 of the ported mandrel 21 and causing the ball sealers 25 to seat on those perforations 28 which do not require treatment or are not desirable to treat, and to allow the other, upper perforations 47 to be treated.

Figure 3:
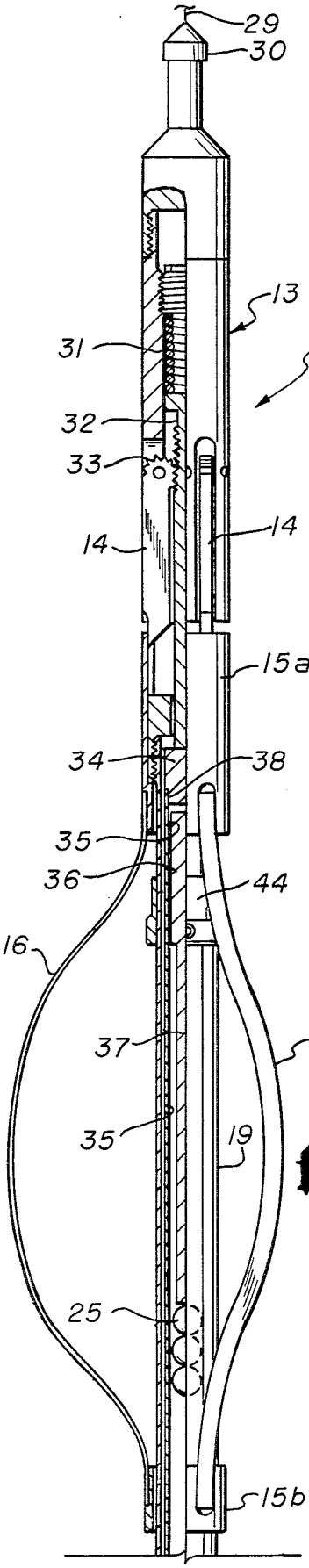
FIG. 3 is an enlarged vertical partial sectional view of the upper portion of the embodiment shown in FIG. 1.
Figure 4:
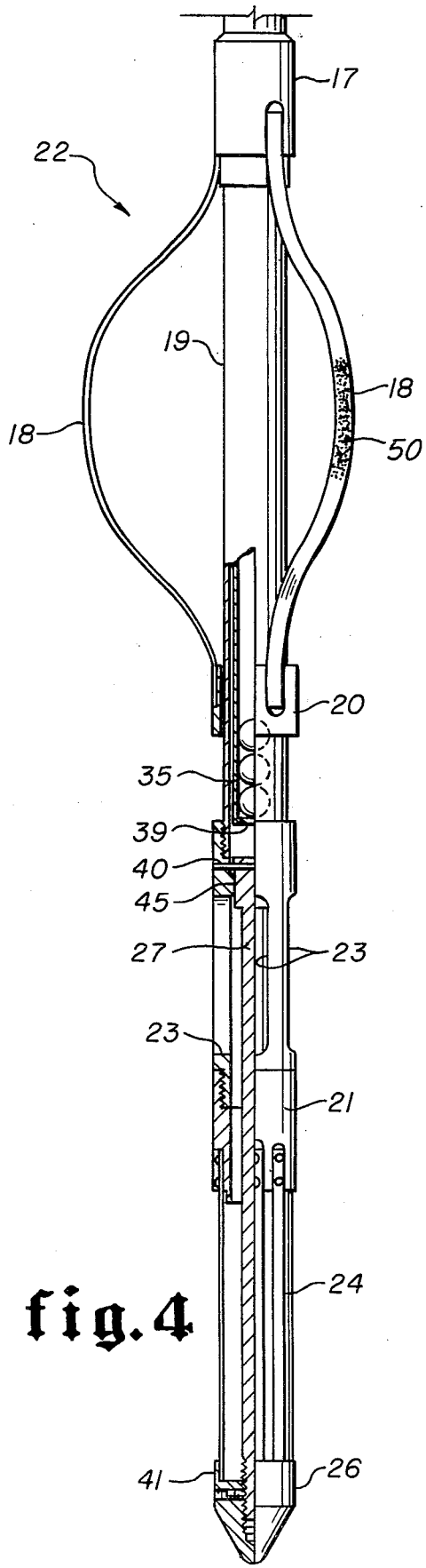
FIG. 4 is an enlarged vertical partial sectional view of the lower portion of the embodiment shown in FIG. 1.
Figure 5:
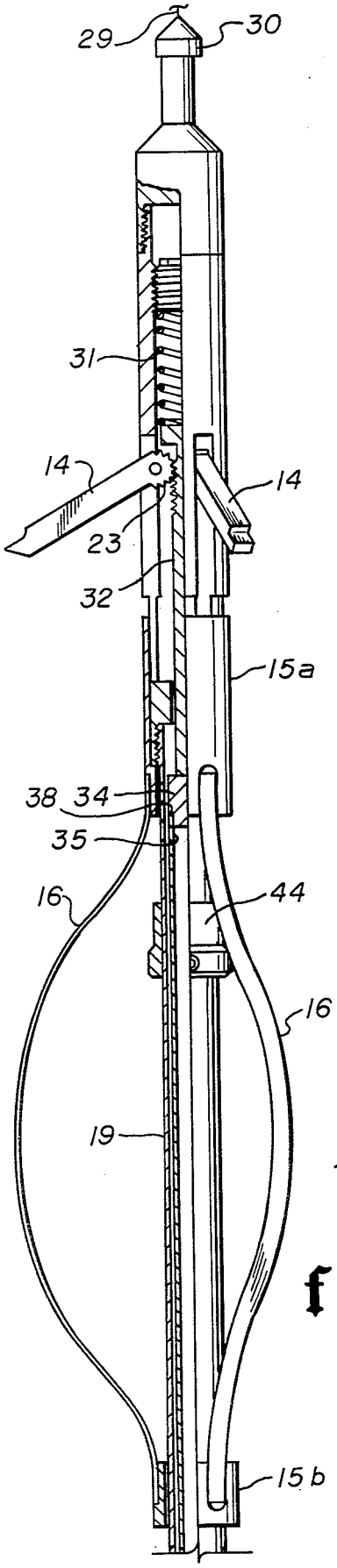
FIG. 5 is an enlarged vertical partial sectional view of the upper portion of the embodiment shown in FIG. 2.

In FIGS. 3 and 4 the apparatus of FIG. 1 is shown in enlarged detail and the specific operation of this embodiment will now be described. As stated above, the embodiment in FIGS. 1, 2, 3, 4, 5 and 6 is actuated for seating in the well casing an upward pull on cable 29 to cause the bowed springs 16 to bind against the casing thereby causing slidable collar 15*a* and 15*b* both to slide along the tubular member 19. The binding of bowed springs 16 may be enhanced by providing gripping surfaces 50 such as machined or stamped teeth or carborundum fragments embedded in the spring on the springs at those points contacting the casing. As the slidable collar 15*a* slids away from mandrel 13 it clears the ends of the seating members 14 which are pivotally mounted arms having a pinion 33 on the end of the arm which is pivotally mounted. Said pinion 33 engages a rack means 32 which is biased by compression spring 31, such that when the slidable collar 15*a* releases the arms 14 the compression spring expands driving the rack 32 toward the tubular member 19 and at the same time engaging the pinion 33 and thereby forcing the arms 14 outward to engage the casing 12. This engagement prevents the further downward movement of the apparatus 22. (As shown in FIG. 5).

The movement of rack 32 toward the tubular member 19 forces it against plug 34. Located about the end of plug 34 away from the rack means is an annular recess 38 wherein a second tubular member or ball tube 35 is abutted. The ball tube 35 is slidably situated within the tubular member 19. The movement of the rack means 32 against the plug 34 forces the plug 34 against the ball tube 35 thereby driving the ball tube 35 towards the lower end of the apparatus.

The next operation occurs in FIG. 4 wherein ball tube 35 which has an annular lip 39 is driven against push-off rod 27 shearing shear pin 40 and freeing the push-off rod 27 which is connected to the end cap 26.

Figure 6:
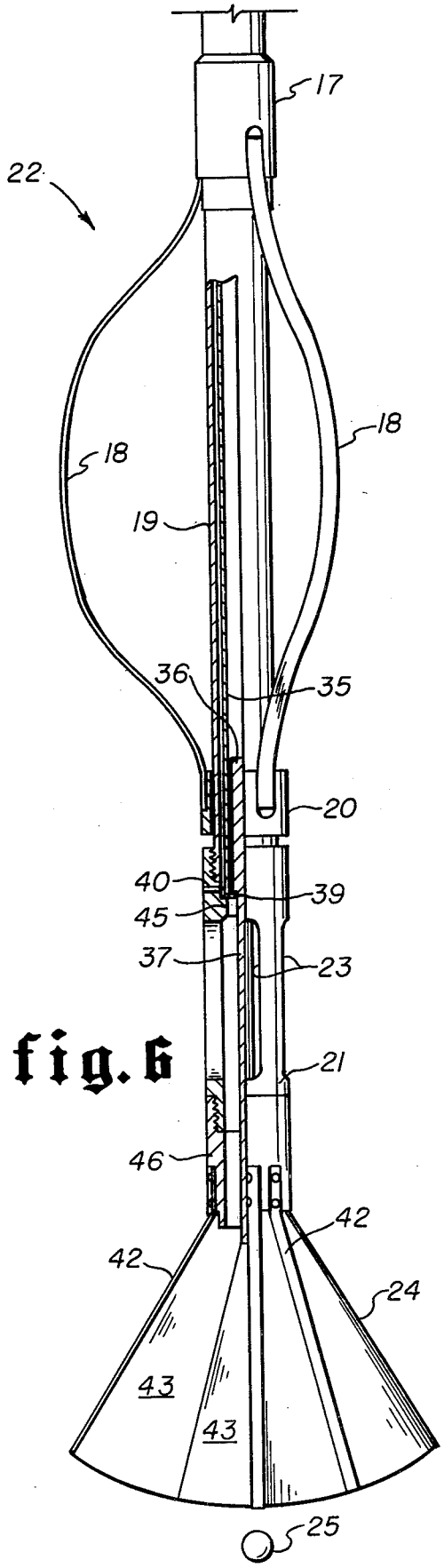
FIG. 6 is an enlarged vertical partial sectional view of the lower portion of the embodiment shown in FIG. 2.

End cap 26 has been engaging the expandable diaphragm by means of the annular lip 41. The freeing of the push-off rod 27 causes it and the end cap 26 to fall away into the well bore. The push-off rod and the end cap may be made of a consumable material such as aluminum in order not to add to the debris in the rathole of the well. The dropping away of the end cap and push-off rod allows the expandable diaphragm 24 to expand as shown in FIG. 6.

In this embodiment, the expandable diaphragm is shown to be composed of a plurality of spring members 42 which are steel leaf springs, biased outwardly from diaphragm mandrel 46 and each of which has attached thereto generally trapezoidally shaped members 43 which are each over lapped to form a frusto-conical shaped diaphragm with the smaller base of the frusto-conical section being attached to the diaphragm mandrel 46. The trapezoidally shaped members may be a material such as a beryllium-copper alloy each of which are attached (by soldering, riveting or welding) to one of the spring members 42. However, a continuous member such as a wire mesh or a solid continuous member such as an elastomeric film may be used to form the diaphragm.

After the apparatus is seated, it may be subsequently recovered by withdrawal of the cable 29. Provided that the apparatus was originally placed by the use of a wireline running tool, (as is well known in the art and not shown) which is adapted to attach to the fishing neck 30 such that the apparatus be left in place, the apparatus can be recovered in a separate operation by the use of an appropriate fishing tool.

In this embodiment, since it is desirable to recover the apparatus, the collar 17 is fixedly attached such that the upward movement of the apparatus is facilitated by allowing the slidable collar 20 to move down the tubular member 19 reducing the resistance or removal by bowed springs 18. A similar reduction of the resistance of the upward movement is obtained as slidable collar 15*a* contacts fixed collar 44 while slidable collar 15*b* is still free to slid along tubular member 19 thereby reducing the resistance of the bowed springs 16 to the upward movement of the apparatus.

As described above in regard to the schematic FIGS. 1 and 2, upon the positioning and seating of the apparatus as shown in FIGS. 5 and 6, the ball sealers 25 are forced out of the ball tube 35 by sinker 36 and rod 37 attached thereto. The ball sealers 25 had been previously held in the ball tube 35 by the push-off rod 27 which is shown to be removed in FIG. 6. The balls are of such a diameter as to freely pass through the annular lip 39 of the ball tube 35, however the sinker 36 is a larger diameter than the opening formed by the annular lip 39 and seats thereon while the rod 37 extends through ported mandrel 21, diaphragm mandrel 46, and slightly into the expandable diaphragm 24, thereby preventing any of the buoyant ball sealers from reentering the apparatus. The flow of the treating fluid through the ports 23 and through the mandrels 21 and 46 into the expandable diaphragm 24 causes the balls to be carried down to the perforations 28 as shown in FIG. 2. Should the flow of treatment fluid be interrupted for any reason, the ball sealers will merely rise back to the expandable diaphragm 24 and remain there until the fluid flow is restarted or until otherwise recovered or allowed to rise through the casing to the surface by removal of the placement apparatus as described above.

In the FIG. 6, the ball tube 35 is shown to have moved slightly past the shear pin 40 which has been sheared off and is stopped by a slight annular upset 45 within ported mandrel 21 thereby placing the ball tube over the jagged shear pin to prevent the inadvertent snaring of a ball sealer on the pin and holding the ball sealers within the ball tube 35.

Figure 7:
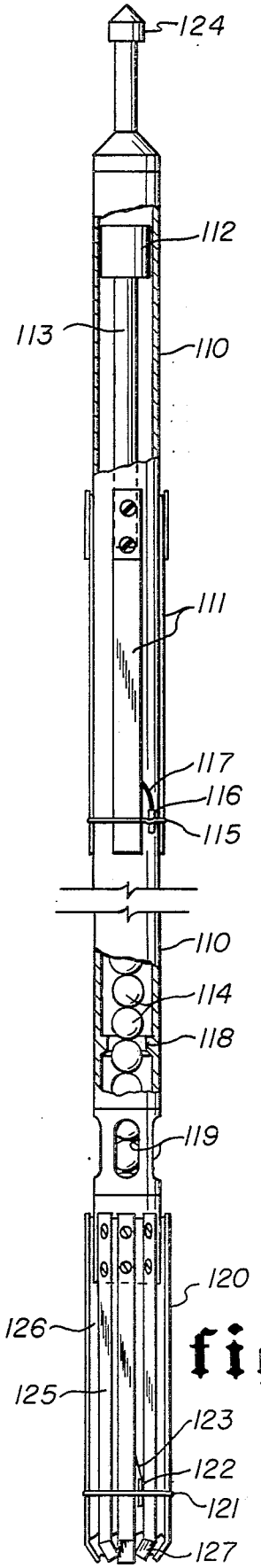
FIG. 7 is an enlarged vertical partial sectional view of an alternative embodiment of the present invention in the configuration for movement in the well casing.
Figure 8:
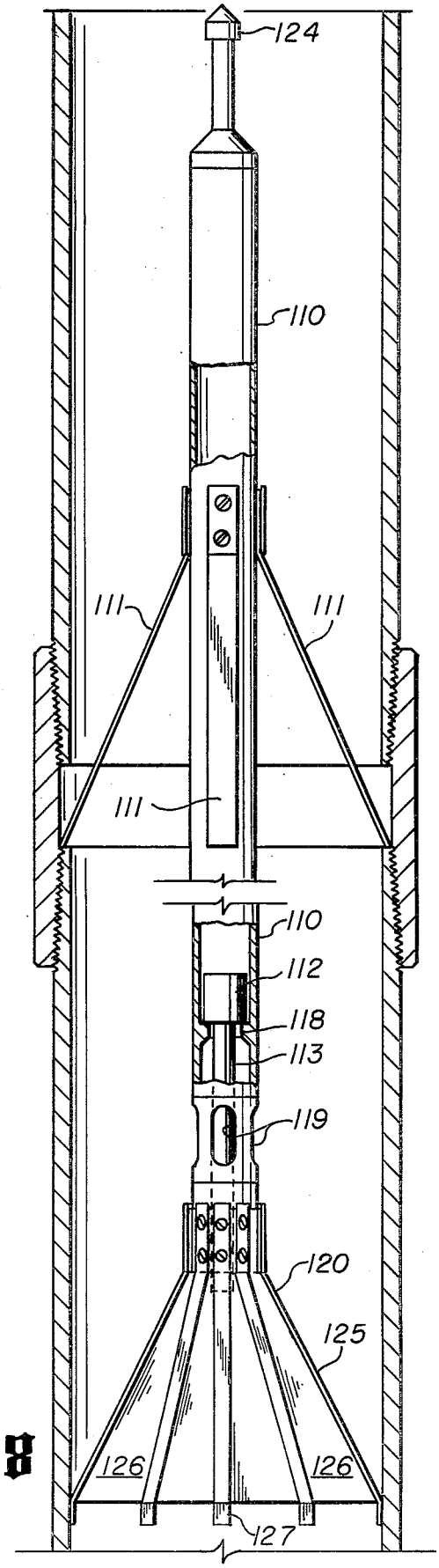
FIG. 8 is an enlarged vertical partial sectional view of the alternative embodiment of FIG. 7 in a positioned and configuration.

FIGS. 7 and 8 show an alternate embodiment of the present placement apparatus in the closed (FIG. 7) and expanded configuration (FIG. 8). In this embodiment, the apparatus is comprised of a tubular member 110 having seating means 111 which are in this embodiment spring steel members which are attached to the tubular member and which are biased outwardly therefrom and which are shown in FIG. 7 to be retained by retaining member 115 in a configuration which allows the apparatus to be lowered through the production tube (not shown) to the desired position. The retaining member 115 is released by ignition of the electric squib 116 which is connected by means of electrical wire 117 to the surface.

The expandable diaphragm 120 is similarly retained in a closed configuration by a retaining means 121 which is released by ignition of the electric squib 122 which is connected to the surface by electrical wire 123.

The expandable diaphragm 120 is similar to that described in regard to FIGS. 1, 2, 3, 4, 5 and 6. It is composed of spring members 125 which are steel leaf springs which are biased outwardly from the tubular member 110. Each of the spring members 125 is attached to a trapezoidally shaped member 126 which form the expandable diaphragm which has the configuration of a frusto-conical section. The expandable diaphragm 120 is attached by means of the spring members 125 to the tubular member 110 at the smaller base of the frusto-conical section. In the closed configuration as shown in FIG. 7, the lower end 127 of each spring member 125 extends inwardly thereby restricting the open area at that end such that the ball sealers 114 contained in the tube will not drop out of the apparatus.

When the apparatus is seated as shown in FIG. 8, where the arms 111 are extended and engaged in a discontinuity in the casing wall and the expandable diaphragm 120 is extended and contacting the casing wall, the retaining effect of the lower end members 127 of the spring members 125 is removed and the sinker 112 and rod attached thereto 113 forces the ball sealers 114 down the tube and out at least into the area of the expandable diaphragm, with the sinker being retained in the apparatus by annular lip 118 which extends inwardly from the inner wall of tubular member 110. The rod 113 extends through the lower portion of the tubular member to a point at or slightly into the expandable diaphragm 120, thereby blocking the reentry of the ball sealers into the tubular member. A treatment fluid flowing into the well under pressure will pass through ports 119 and through the tubular member into the frusto-conically shaped expanded diaphragm and will carry the ball sealers downwardly to the perforated zone which is to be sealed. In this embodiment the arms 111 of which there are a plurality, i.e., 3 or 4 or even more, and the expandable diaphragm 120 serve to centralize the apparatus in the wellbore and the arms 111 serve to seat the apparatus therein to prevent further downward movement after the positioning. Bowed spring centralizers (not shown) may be used to provide improved centralization where necessary. Where such centralizers are used, a plurality of arms 111 are not required, since as few as one arm can provide sufficient resistence to downward motion. This apparatus which may be connected to the surface by a cable (not shown) or may be left in the well during the treatment and be subsequently recovered with a suitable fishing tool which is adapted to engage the fishing neck 124. The configuration of both arms 111 and the expandable diaphragm 120 is such that the device is easily pulled upward through the well and through the production tube to the surface where it can then be reloaded and new retaining members 115, 121, squibs 116 and 122 and electrical connections 117 and 123 respectively may be attached and used in another or the same location.

Figure 9:
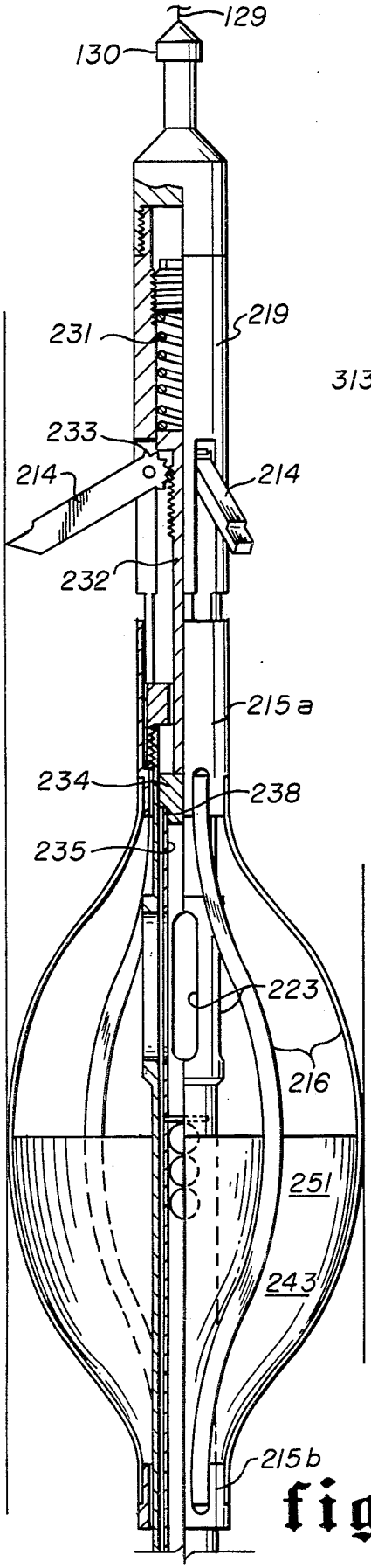
FIG. 9 is an enlarged vertical partial sectional view of the upper portion of a second alternative embodiment of the present invention in a positioned configuration.
Figure 10:
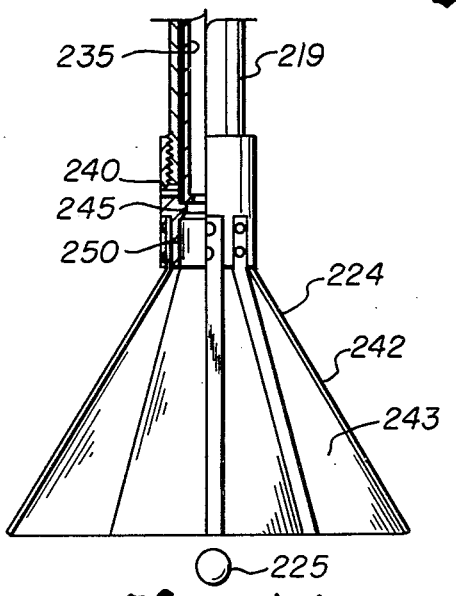
FIG. 10 is an enlarged vertical partial sectional view of the lower portion of the second alternative embodiment of FIG. 9.

FIGS. 9 and 10 show a second alternate embodiment which is very similar to the embodiment of FIGS. 1, 2, 3, 4, 5 and 6. The embodiments of FIGS. 9 and 10 corresponds very closely with that of FIGS. 5 and 6 wherein the apparatus has been seated and expanded in the wellbore for the placement of the ball sealers. The principal differences are: the relocation of the ports or openings from the lower end of the placement apparatus to a point above the ball sealers and adjacent to the upper end of the tubular member 219, elimination of the sinker 36 and its attached rod 37 and the elimination of the annular lip 39 at the lower end of the ball tube 35, otherwise the elements of the two apparatus are the same and the operation is the same with the exception noted below.

As with the apparatus in FIGS. 5 and 6, the apparatus of FIGS. 9 and 10 has been seated and the expandable diaphragm 224 has been expanded by an upward pull of the apparatus which has caused the slidable collars 215*a* and 215*b* to slide downward along the tubular member 219 thereby releasing the arm 214 which is pivotally mounted and engages rack 232 adjacent to the pivotal end by means of pinion 233 such that the compression spring 231 expands, driving the rack 232 downward and rotating the arm 214 outward. The rack 232 abutts plug 234 which in turn abutts ball tube 235 which is seated in an annular recess 238 around plug 234. Downward movement of the rack 232 displaces ball tube 235 downward, which has forced the push-off rod (not shown) downward shearing shear pin 240 with the ball tube 235 being restrained from further movement downward by annular lip 245 in mandrel 250. As in the earlier embodiment, the push-off rod which was attached to the end cap (not shown) and the end cap had dropped away thereby freeing the expandable diaphragm 224.

The ball sealers 225 are removed from the ball tube 235 by means of the flow of treatment fluid, which is directed through ports 223 because of the expandable diaphragm 251 which is mounted in the bowed springs 216. In this embodiment, there are additional bowed springs to accomodate the forces exerted on the trapezoidally shaped members 243 which form the expandable diaphragm which has a generally frusto-conical configuration, particularly when the force of the treatment fluid presses against the expanded diaphragm and causes the treatment fluid to proceed down the wellbore beyond the placement apparatus by passage into the bore thereof through the ports 223. It is this flow which displaces and carries the ball sealers 225 down and out of the ball tube 235, eliminating the necessity for the sinker 36. The trapezoidally shaped members 243 are attached within the bowed springs 216 so that substantially all of the flow is restricted at that point. The ball tube 235 also contains ports corresponding to ports 223.

It has been found in actual practice that the expandable diaphragm 224 does not by itself, restrict the flow of the treatment fluids sufficiently to expel the ball sealers from the tubular member. The treatment fluid tends to force its way around and through the expandable diaphragm 224. However, when the same configuration is rotated 180° as shown in FIG. 9 and located within the bowed spring 216 as in the arrangement of the expandable diaphragm 251 the pressure of the fluid tends to seal the individual trapezoidally shaped member and spring member together and to force them outwardly against the casing such that substantially all of the flow must proceed through the ports 223.

Figure 11:
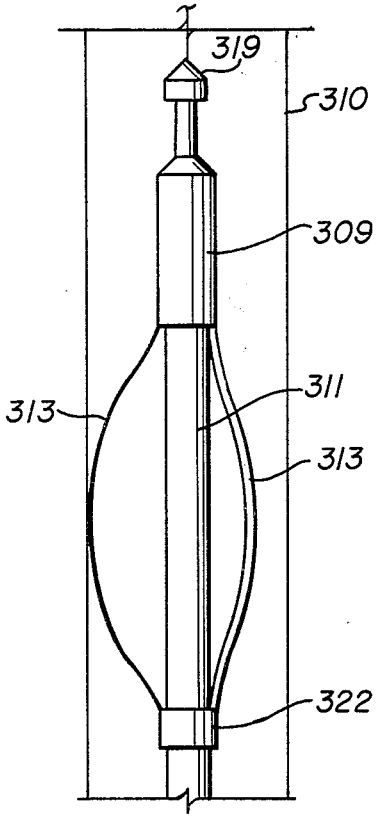
FIG. 11 is a schematic view of the upper portion of a third alternative embodiment of the present invention in a positioned configuration.
Figure 12:
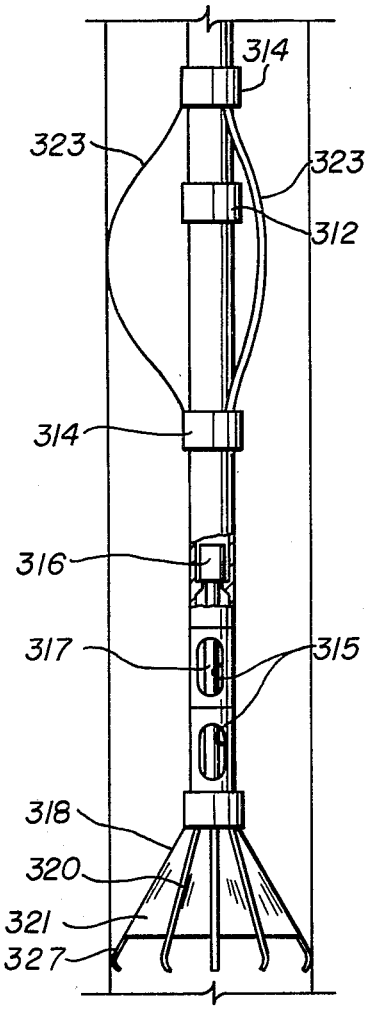
FIG. 12 is a schematic view of the lower portion of the third alternative embodiment of FIG. 11 with a partial sectional view.

In FIGS. 11 and 12 a third alternate embodiment is disclosed. This particular embodiment differs from each of the prior embodiments in that there are no arms which extend from the tubular member to engage the casing wall so as to prevent further downward movement of the apparatus. The means of positioning the appatatus in the wellbore at the desired location is by the use of the bowed springs 313 and 323. Hence, this apparatus serves a dual function. It is used to selectively place the buoyant ball sealers above and adjacent to the perforations to be sealed and after the treatment it provides an optional means for the elimination or removal of the buoyant ball sealers from the wellbore system. This is accomplished merely by forcing the apparatus downward after the treatment has ceased and there is no pressure differential across the perforations. The ball sealers will have come loose from the perforations and will have risen to the area of the expandable diaphragm 318 and by forcing the apparatus downward to the bottom of the well, i.e., the rathole. Hence, the apparatus and the ball sealers are removed from the area of operation. This eliminates the need for any traps upstream and any special recovery devices to remove the buoyant ball sealers from the fluid. Since the apparatus is equipped with a fishing neck 319 it may be retrieved from the well if desired, or if further treatment is necessary the device may merely be raised to a point slightly above and adjacent to the portion of the formation to be sealed and the treatment fluid commenced. The ball sealers which were trapped in the rathole by the device will then be reusable and reseated onto any perforation beneath the apparatus. This approach may be repeated so long as the apparatus and the ball sealers are functional.

More specifically, the apparatus of this embodiment comprises a tubular member 311 having a fishing neck 319 at the upper end thereof, positioning means which are comprised of bowed spring 313 attached to the fixed collar 309 and slidable collar 322, and bowed springs 323 attached to slidable collars 314. A collar stop member 312 is supplied so that the slidable collars 314 may move so as to allow compression of the bowed springs when the apparatus is moved through production tubing but to prevent the bowed springs from obstructing ports 315. In this present configuration the apparatus is shown as deployed in a casing with the expandable diaphragm 318 opened.

The expandable diaphragm may be that described before, i.e., comprised of a plurality of spring members 320 having affixed to each spring member a trapezoidally shaped member 321 such that on expansion a substantially frusto-conical section is the result with the smaller base of the frusto-conical section being attached to the tubular member 319. In order to insure a lesser likelihood that apparatus will snag on any projections in the well casing if it is forced to the bottom, the lower end of each spring member has an arcuate shape which allows the spring member to ride along the casing surface without snagging. The trapezoidally shaped members are not required to extend to the casing wall, however, the space between the wall and the trapezoidally shaped member should be maintained of a size too small to allow the ball sealers to pass through but to provide a degree of clearance so that the trapezoidally shaped members do not snag on projections or rough areas on the casing wall during downward tool movement.

Although not shown, the apparatus of FIGS. 11 and 12 may have the retaining member consisting of an electrically operated squib such as that shown in FIG. 7 which can be activated when the apparatus reaches the desired location in the casing. The curved lower ends 327 of the spring members serve to retain the ball sealers in the apparatus until the retaining member is released and the expandable diaphragm 318 is opened. A sinker 316 and the rod attached thereto 317 then force the ball sealers into the frusto-conically shaped, expandable diaphragm 318 and the flow of treatment fluid through ports 315 then carries the ball sealers to the perforations in the zone to be sealed as described hereinabove.

It should be appreciated that although certain specific embodiments have been disclosed that the elements related thereto may be combined with various other embodiments which are contemplated in the scope of this invention. For example as the use of both mechanical release means and electrically operated squibs, such a combined apparatus may have the means for seating the apparatus to prevent further downward movement operated by mechanical means as shown in FIGS. 1, 2, 3, 5 and 9 and the expandable diaphragm retained by a retaining member which is released by ignition of an electrical squib as shown in FIG. 7. Similarly, the inverted expandable diaphragm as shown in FIG. 9, situated within a set of bowed springs may be employed in conjunction with an electrically operated squib release means. These and other permutations and variations of the components disclosed herein are contemplated within the scope of the invention.

The invention claimed is:

1. An apparatus for selective placement of ball sealers for fluid treatment of a well, said ball sealers having a density less than the density of said fluid, comprising:

a first tubular member, a second tubular member slidably mounted within said first tubular member, a first expandable diaphragm having a first frusto-conical section attached at the small diameter of said frusto-conical section to said first tubular member at one end thereof, said expandable diaphragm extending beyond said first tubular member, a plurality of pivotally mounted extendable arms mounted to said first tubular member toward the end of said first tubular member distal to said first expandable diaphragm, said arms each having a pinion thereon, each said pinion engaging a rack means within said first tubular member, said rack means abutting one end of said second tubular member and biased toward said second tubular member, said arms being retained in an unextended position by a first collar slidably mounted on said first tubular member over said arms, a retaining cap having means thereon to engage and retain said first expandable diaphragm in an unexpanded position, a push off member connected to said retaining cap and abutting the end of said second tubular member distal to said rack means and, means releasably holding said push off member in position.

2. The apparatus according to claim 1 whereby said sleeve being slidably disengaged from said arms, said arms pivotally rotating to extend outward from said first tubular member by linear movement of said biased rack means, said second tubular member being moved linearly toward said push off member by said biased rack means, said means releasably holding said push off member in position being released and said retaining cap moving linearly and disengaging from said first expandable diaphragm allowing said first expandable diaphragm to expand, said retaining cap and push off member being freed from the apparatus.

3. The apparatus according to claim 1 wherein said rack means comprises a plurality of racks, one each engaging one of said pinions.

4. The apparatus according to claim 1 having a second expandable diaphragm having a second frusto-conical section attached at the small diameter of said frusto-conical section to said first tubular member at a point intermediate the ends of first tubular, the small diameter of said second frusto-conical section being proximal to said first expandable diaphragm and the large diameter of said second frusto-conical section being distal to said first expandable diaphragm.

5. The apparatus according to claim 4 wherein said second expandable diaphragm is mounted to a plurality of outwardly biased bowed springs mounted to at least one slidable sleeve, about said first tubular member.

6. The apparatus according to claim 4 wherein there are a plurality of ports in said first and second tubular members adjacent to said rack and between said rack and said second expandable diaphragm.

7. The apparatus according to claim 1 wherein said first slidable collar is attached to a plurality of bowed springs mounted on said first tubular member, and biased outwardly therefrom.

8. The apparatus according to claim 7 wherein said bow springs are mounted to a second slidable collar on said first tubular member opposite said first collar.

9. The apparatus according to claim 8 wherein said second tubular member has an inwardly protruding annular lip at the end thereof proximal to said first expandable diaphragm.

10. The apparatus according to claim 9 therein a sinker is slidably mounted in said second tubular member, said sinker having a diameter larger than said annular lip.

11. The apparatus according to claim 10 wherein said sinker has rod affixed thereto extending toward said first expandable diaphragm.

12. The apparatus according to claim 11 wherein a portion of said first tubular member having said first expandable diaphragm thereon extends beyond said second tubular member, said portion having a plurality of ports therein.

13. The apparatus according to claim 12 having means therein to prevent said second tubular member from moving into said portion of said tubular member having ports therein.

14. An apparatus for selective placement of ball sealers for fluid treatment of a well, said ball sealers having a density less than the density of said fluid comprising:

a tubular member, a plurality of pivotally mounted arms, biased to extend outward from said tubular member, a first restraining member about said tubular member over said arms, restraining said arms to said tubular member, an electrically activated pyrotechnic device associated with said restraining member, an expandable diaphragm having a frusto-conical section attached at the smaller diameter to one end of said tubular member and biased to extend outward therefrom, a second restraining member about said expandable diaphragm restraining said expandable diaphragm unexpand, an electrically activated pyrotechnic device associated with said second restraining member, and means to electrically activate said pyrotechnic devices.

15. The apparatus according to claim 14 wherein there is a plurality of ports in said tubular member proximal to said arms, said arms and said expandable diaphragm being located at distal ends of said tubular member.

16. A method for the selective sealing of perforations in a well casing below production tubing using independent sealing member having a density less than the density of the fluid in said casing, comprising:

passing an apparatus comprising a tubular member, containing a plurality of sealing members releasably held therein, means on said tubular member for positioning said apparatus at a desired location in said well casing and means on said tubular member for blocking said well casing to prevent upward movement of said independent sealing members past said apparatus, through said casing into said production tubing, positioning said apparatus adjacent to and above said perforations to be sealed, deploying said means for blocking said well casing, releasing said independent sealing members from said tubular member into said well casing below said apparatus, and creating a pressure differential across said perforations thereby seating said independent sealing members thereon.

17. The process according to claim 16 wherein said pressure differential is caused by a flow of said fluid into said well casing.

18. An apparatus for selective placement of ball sealers, said ball sealers having a density less than a treating fluid in a well casing comprising:

(a) a tubular member having a bore therethrough, said member capable of releasably retaining a plurality of said ball sealers in said bore, (b) means on said tubular member for positioning said apparatus at a desired location in said well casing, (c) means on said tubular member for blocking said well casing to prevent upward movement of said ball sealers past said apparatus, said blocking means comprising an expandable diaphragm having a frustoconical section and biased to extend outward from said tubular member to substantially the internal diameter of said well casing around said apparatus, and (d) releasable means engaging and restraining said expandable diaphragm from extending.

19. The apparatus according to claim 18 wherein said means (c) is attached at one end of said tubular member at the smaller base of said frusto-conical section.

20. The apparatus according to claim 18 wherein said means (b) for positioning additionally comprises at least one set of a plurality of conformable bowed springs biased outwardly from said tubular member for contacting said well casing.

21. The apparatus according to claim 20 having gripping means on said bowed springs on surfaces contacting said well casing.

22. A method for the selective sealing of perforations in a well casing using independent sealing member having a density less than the density of the fluid in said casing comprising;

passing an apparatus comprising a tubular member, containing a plurality of sealing members releasably held therein, means on said tubular member for positioning said apparatus at a desired location in said well casing and means on said tubular member for blocking said well casing to prevent upward movement of said independent sealing members therepast, positioning said apparatus adjacent to and above said perforations to be sealed, deploying said means for blocking said well casing, releasing said independent sealing members from said tubular member into said well casing below said apparatus, and creating a pressure differential across said perforations thereby seating said independent sealing members thereon.

23. An apparatus for selective placement of ball sealers in a well casing below production tubing, said ball sealers, having a density less than a treating fluid in a well casing comprising:

(a) a tubular member having a bore therethrough, said member capable of releasably retaining a plurality of ball sealers in said bore, (b) wireline means on said tubular member for positioning said apparatus at a desired location in said well casing, and (c) a downwardly opening expandable diaphragm having a frusto-conical section, said diaphragm having a retracting position to permit movement through said production tubing and an expanded position where said diaphragm extends outwardly from said tubular member to substantially the internal diameter of said well casing around said apparatus to prevent upward movement of said ball sealers; and (d) means for moving said diaphragm from said retracted position to said expanded position.

* * * * *